US007322656B2

(12) United States Patent
Wang

(10) Patent No.: US 7,322,656 B2
(45) Date of Patent: Jan. 29, 2008

(54) LEG SUPPORT STRUCTURE OF COMPUTER DESK CAPABLE OF SYNCHRONOUS SLIDING MOVEMENT

(76) Inventor: Chih Chiang Wang, 2F, No. 3, Lane 280, Chung-Chan Road, Hsin Tien City, Taipei Hsien (TW)

( * ) Notice: Subject to any disclaimer, the term of this patent is extended or adjusted under 35 U.S.C. 154(b) by 127 days.

(21) Appl. No.: 10/948,810

(22) Filed: Sep. 24, 2004

(65) Prior Publication Data

US 2006/0071530 A1 Apr. 6, 2006

(51) Int. Cl.
*A47C 16/00* (2006.01)

(52) U.S. Cl. ..... 297/423.41

(58) Field of Classification Search ..... 297/423.19, 297/423.41; 248/299.1, 918, 118; 312/208.1, 312/271, 273, 323, 223.3; 108/92, 93, 102, 108/106, 138, 193, 50.01, 50.02
See application file for complete search history.

(56) References Cited

U.S. PATENT DOCUMENTS 1,975,004 A * 9/1934 Jenkins ..... 312/195
5,377,951 A * 1/1995 Johnson et al. ..... 248/639
5,419,525 A * 5/1995 Hilton ..... 248/371
D389,327 S * 1/1998 King ..... D6/353
5,957,059 A * 9/1999 Burhman ..... 108/13
6,113,182 A * 9/2000 Wise ..... 297/119
6,840,583 B1 * 1/2005 Turner et al. ..... 297/423.19

* cited by examiner

*Primary Examiner*—Sarah B. McPartlin
(74) *Attorney, Agent, or Firm*—Birch, Stewart, Kolasch & Birch, LLP

(57) ABSTRACT

The present invention provides a leg support structure of a computer desk capable of synchronous sliding movement, comprising a stand, a leg pad, two L-shaped prop stands and two sliding collars. The stand is formed into an inverse U-shape, and the leg pad is formed into a planar configuration. The leg pad comprises a lower pivot opening and an upper pivot opening formed on both sides of the leg pad, wherein the locations of the lower openings and the upper pivot openings are corresponding to positions of a lower pivot and two L-shaped prop stands. The lower pivot is positioned though the lower pivots openings of the leg pad in order to pivot to a support located at a center of the two arcing grooves. The L-shaped prop stands, the two sliding collars, the pulley and a slider are engaged in such that various elevation changes can be achieved.

3 Claims, 7 Drawing Sheets

LEG SUPPORT STRUCTURE OF COMPUTER DESK CAPABLE OF SYNCHRONOUS SLIDING MOVEMENT

FIELD OF TECHNOLOGY

This invention relates to a leg support structure of a computer desk capable of synchronous sliding movement, particularly to one that may be overturned and extended along with the outward sliding movement of the slider for placement of a keyboard, to allow a user to place his/her shank in an easy manner.

BACKGROUND OF INVENTION

Most of the conventional office automation (OA) furniture is not equipped with a part for supporting user's feet, such that the user operating a computer needs to take an upright posture without providing support to various parts of the body, resulting in easy tiring. Though some conventional computer desks are equipped with a part for supporting user's feet, such a part is usually provided at a lower position that does not provide sufficient support to the legs of the human body so as to result in an uncomfortable sitting posture.

This invention, accordingly, aims at overcoming the shortcomings found at the foot support structure of the conventional computer desks.

SUMMARY OF INVENTION

It is an object of this invention to provide a leg support structure of a computer desk capable of synchronous sliding movement, including: a stand is formed into an inverse U-shape, wherein the stand comprises a base and two suspending portions which are perpendicularly to its base. An arcing groove is formed on a middle part of each suspending portion of the stand. A leg pad is formed into a planar configuration as shown in the drawings. The leg pad comprises a lower pivot opening and an upper pivot opening formed on both sides of the leg pad, wherein the locations of the lower openings and the upper pivot openings are corresponding to positions of a lower pivot and two L-shaped prop stands. The lower pivot is positioned though the lower pivots openings of the leg pad in order to pivot to a support located at a center of the two arcing grooves. The leg pad further comprises a lateral side pivoted to a center of the two arcing grooves and another lateral side pivoted to a pulley through two sliding collars rolling respectively in the two arcing grooves. The two sliding collars being each engaged over the vertical sides of the two L-shaped prop stands, and a slider at ends thereof for placement of a keyboard, whereby outward sliding movement of the slider upon experiencing an external force actuates the L-shaped prop stands to cause movement of the sliding collars and to cause the pulley to slide downwards in the arcing grooves, wherein the vertical sliding movement of the sliding collars along the L-shaped prop stands compensates for elevation changes resulted from inward sliding movement of the pulley in the arcing grooves, subjecting the leg pad to be overturned and exteneded along with the sliding movement of the slider to form a leg support structure allow easy use.

It is another object of this invention to provide a leg support structure of a computer desk capable of synchronous sliding movement, wherein the slider closely rests against an underside of the top of the stand in its retracted state, while the leg pad is normal to a front side of the stand, so as to optimize the use of the space without occupying unnecessary space.

It is another object of this invention to provide a leg support structure of a computer desk capable of synchronous sliding movement, where the structure is formed with plural retaining holes on a top of the stand, through which retaining holes bolts pass to be affixed to an underside of the desktop. Or, the stand may be provided with racks at lower bottoms of opposing sides thereof, so as to be placed directly underneath the desktop. Accordingly, this invention allows numerous variations in accordance with the operating surrounding.

The structures and characteristics of this invention can be realized by referring to the appended drawings and explanations of the preferred embodiments.

DESCRIPTION OF PREFERRED EMBODIMENTS

Figure 1:
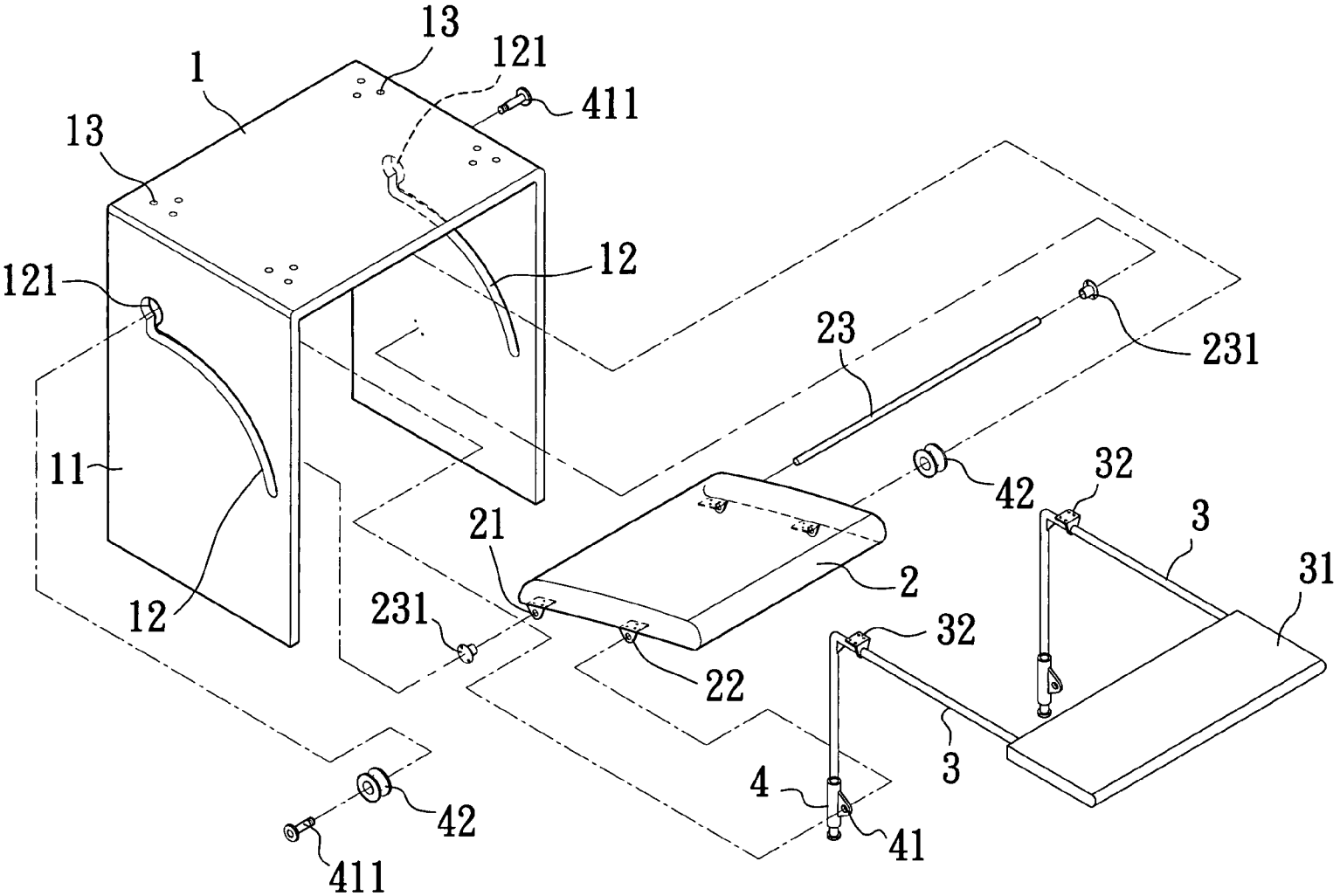
FIG. 1 is an exploded, perspective view of this invention.
Figure 2:
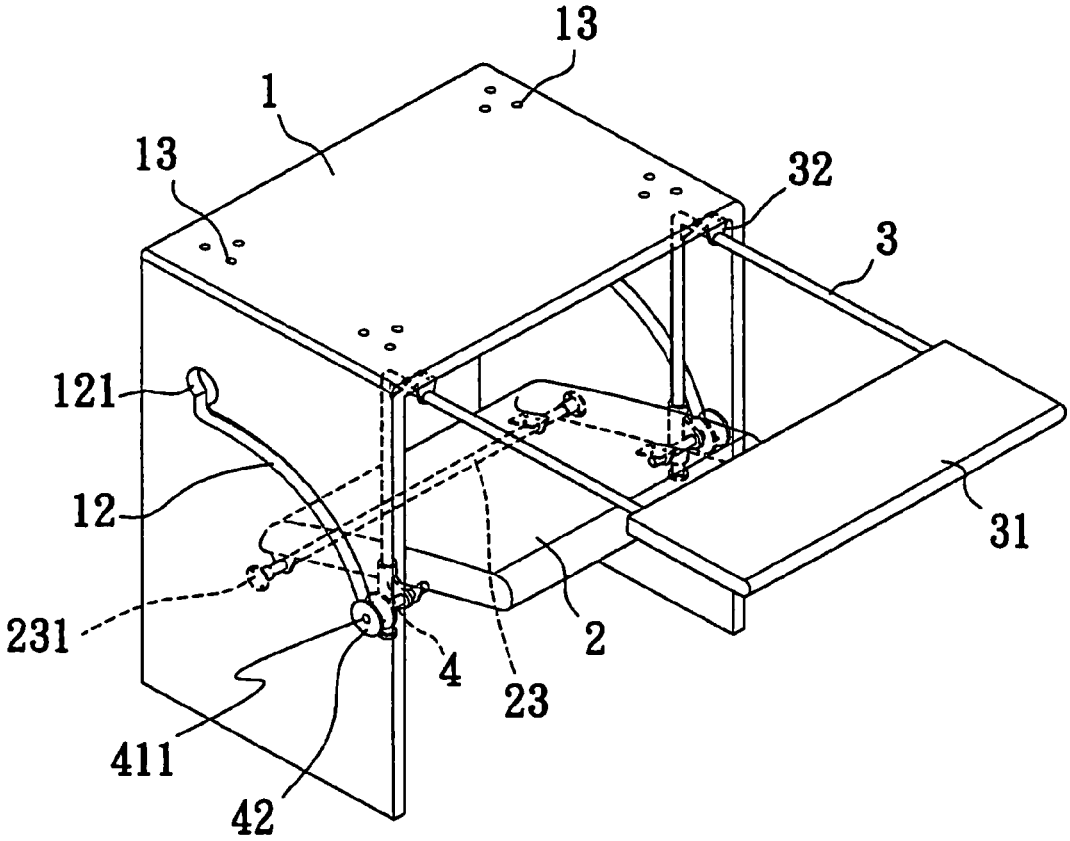
FIG. 2 is an assembled, perspective view of this invention.
Figure 3:
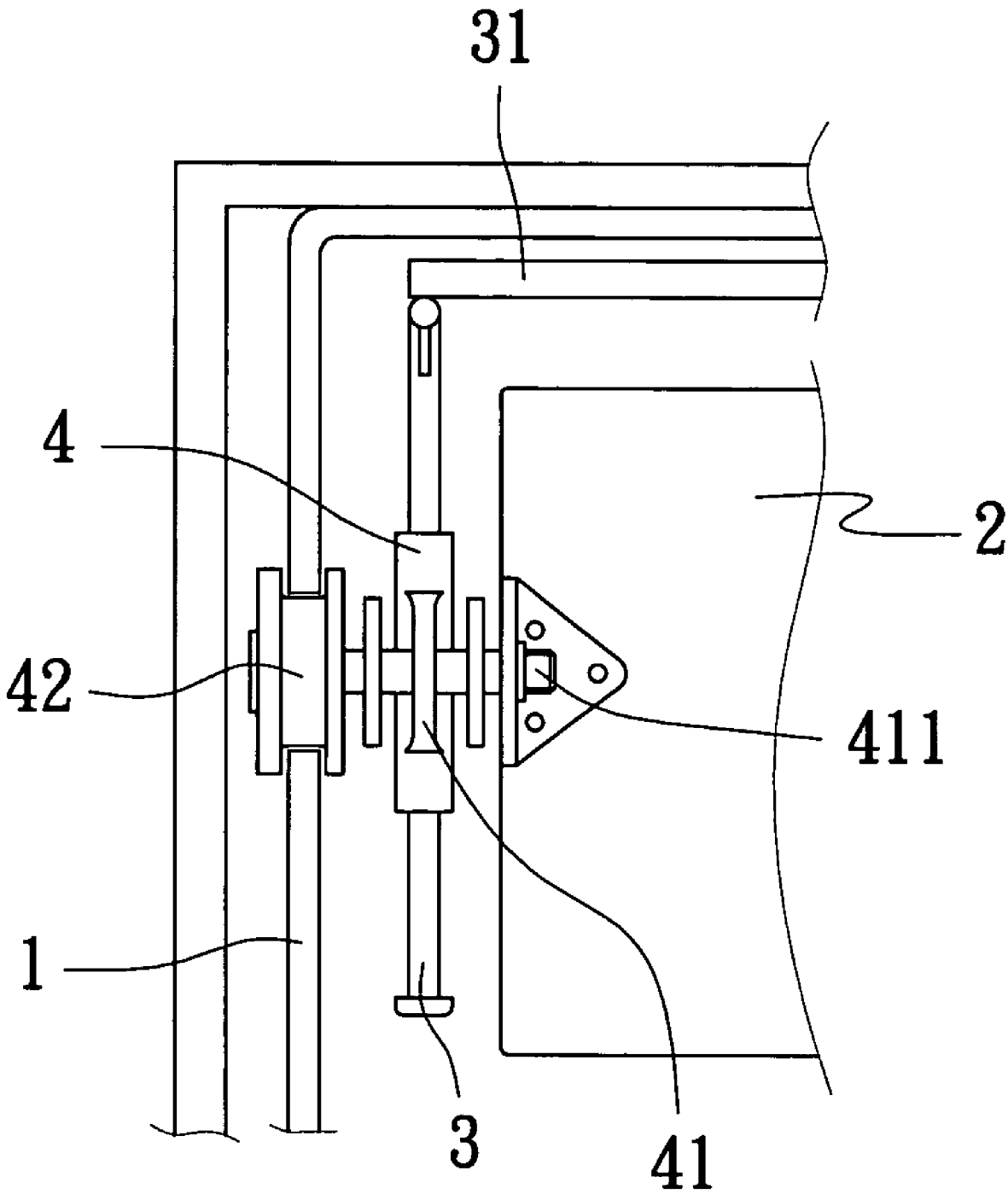
FIG. 3 is an assembled, partial cross-sectional view of this invention.

FIG. 1 is an exploded, perspective view of this invention. FIG. 2 is an assembled, perspective view of this invention. FIG. 3 is an assembled, partial cross-sectional view of this invention. As clearly shown, this invention mainly includes: a stand 1, leg pads 2, L-shaped prop stands 3 and sliding collars 4, wherein the stand 1 is configured as an inverse U-shape, the stand 1 is formed with an arcing groove 12 at each mid-sections of two suspending portions 11 thereof. The arcuate grooves 12 are each formed at an end thereof (top) with a large through hole 121. The stand is further provided at a top thereof with plural retaining holes 13. The leg pad 2 having a planar configuration, comprises a lower pivot opening 21 and an upper pivot opening 22, wherein locations of the lower openings 21 and the upper pivot openings 22 are corresponding to positions of a lower pivot 23 and two L-shaped prop stands 3. The lower pivot 23 is positioned though the lower pivots openings 21 of the leg pad 2 in order to pivot to a support 231 located at a center of the two arcing grooves 12. The horizontal sides of the two L-shaped prop stands 3 are engaged to an underside of the top of the stand 1 by means of a retaining sleeve 32 at midsections thereof. The horizontal sides of the two L-shaped prop stands 3 are joined to a slider 31 at ends thereof for placement of a keyboard. The two sliding collars 4 are each engaged over the vertical sides of the two L-shaped prop stands 3. Each of the sliding collars 4 comprises outer portion, wherein holes 41 are formed at the outer portions of the sliding collars 4 so that an upper pivot 411 can pass through to joint to a pulley 42, and then subsequently pivots to the upper pivot opening 22 of the leg pad 2.

Figure 4:
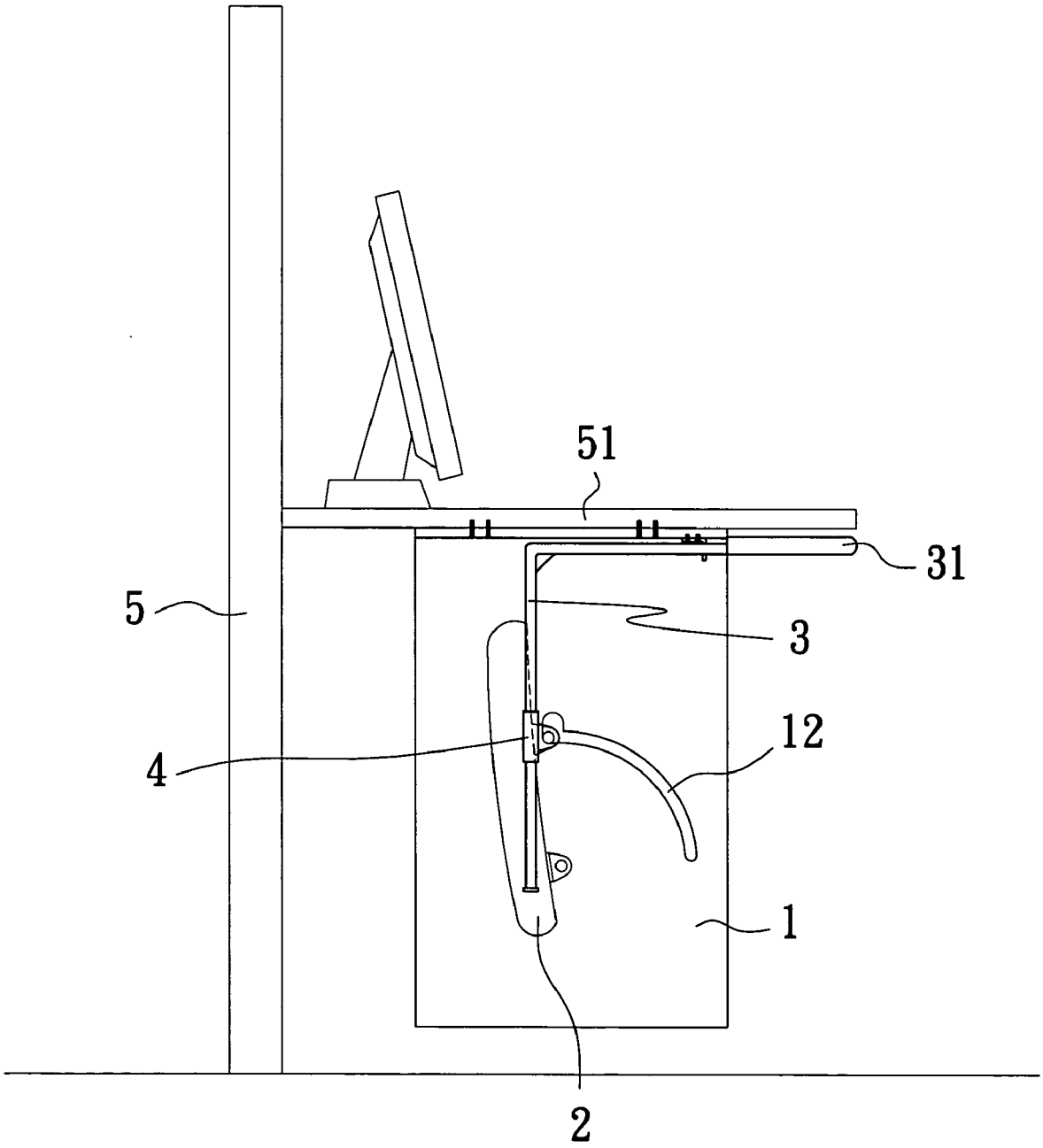
FIG. 4 is a schematic view illustrating a state where this invention is retracted while being assembled to a desktop.
Figure 5:
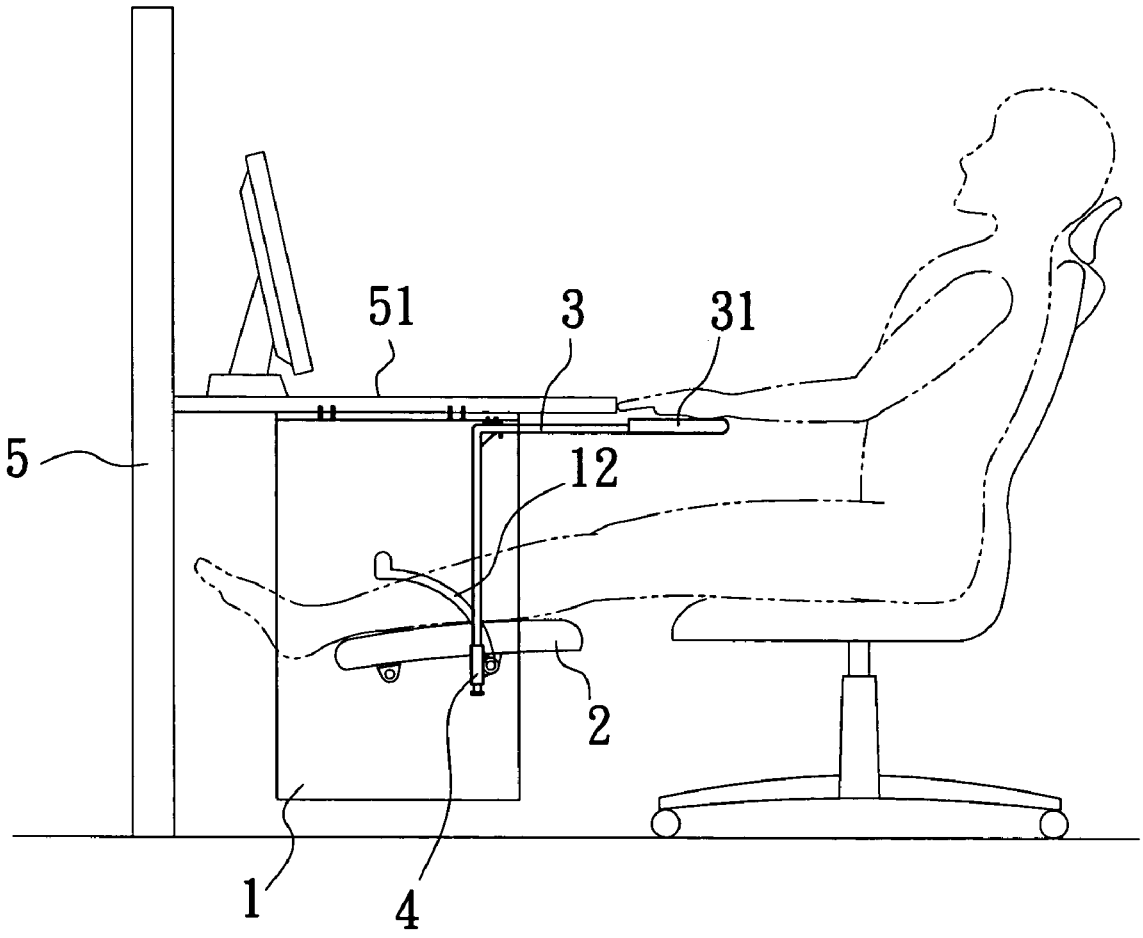
FIG. 5 is a schematic view illustrating this invention in operation.

FIG. 4 is a schematic view illustrating a state where this invention is retracted while being assembled to a desktop. It is known from FIG. 5, that is a schematic view illustrating this invention in operation, that the stand 1 employs plural fasteners that pass through the retaining holes 13 so as to be affixed to an underside of the desk top 51 joined to a partition 5. When the slider 31 slides outwards upon experiencing an external force, the L-shaped prop stands 3 would cause movement of the sliding collars 4 and to cause the pulley 42 to slide outwards in the arcing grooves 12 of the stand 1. At the same time, the sliding collar 4 also slides downwards from the top of the vertical sides of the L-shaped prop stands to compensate for elevation changes resulted from sliding movement of the pulley in the arcuate grooves. At this time, the leg pad is gradually overturned and extended along with the sliding movement of the slider 31 to form a leg support structure that allows a user to place his/her shank in an easy manner.

Figure 6:
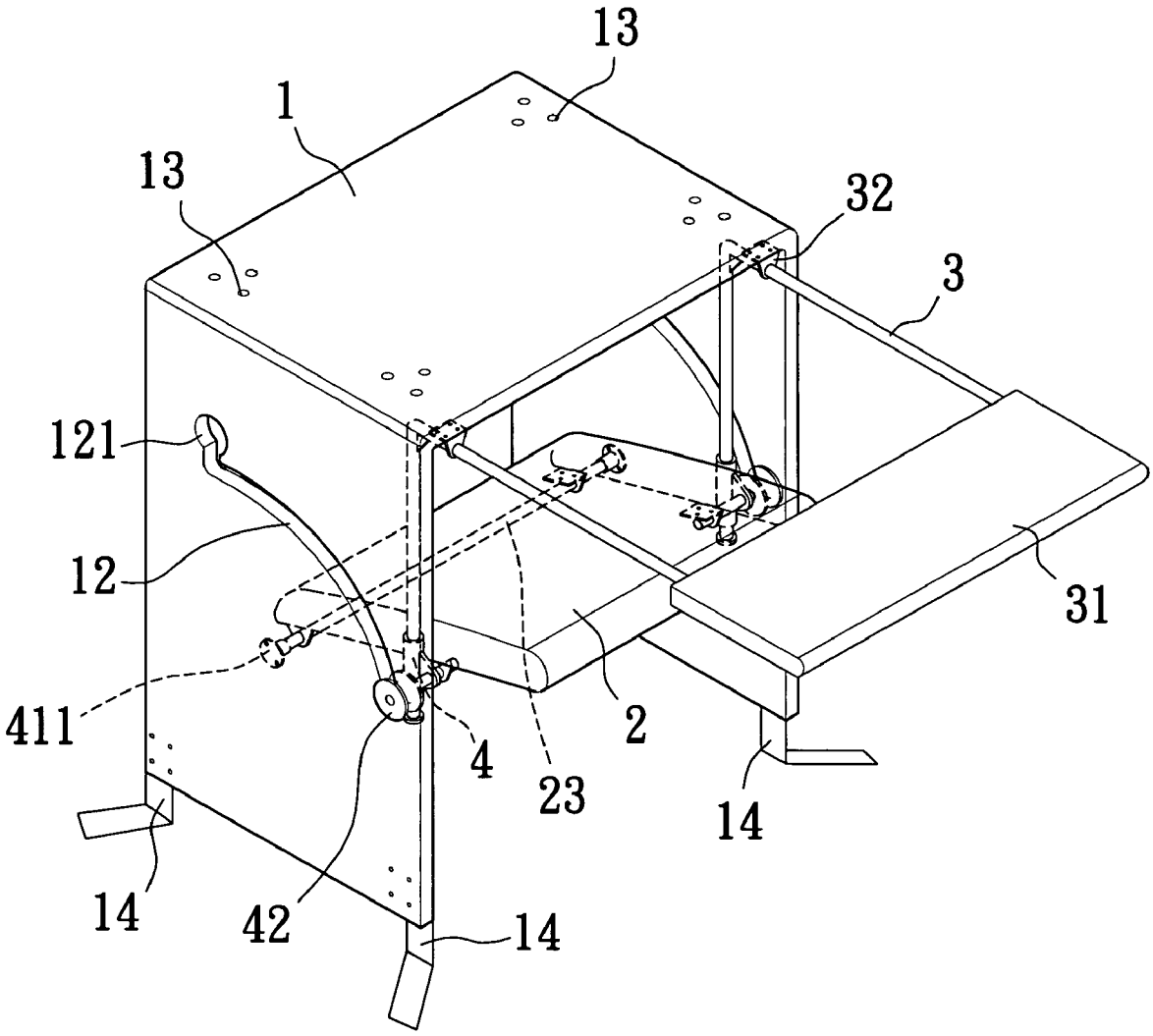
FIG. 6 illustrates the structure of an alternative embodiment of this invention.
Figure 7:
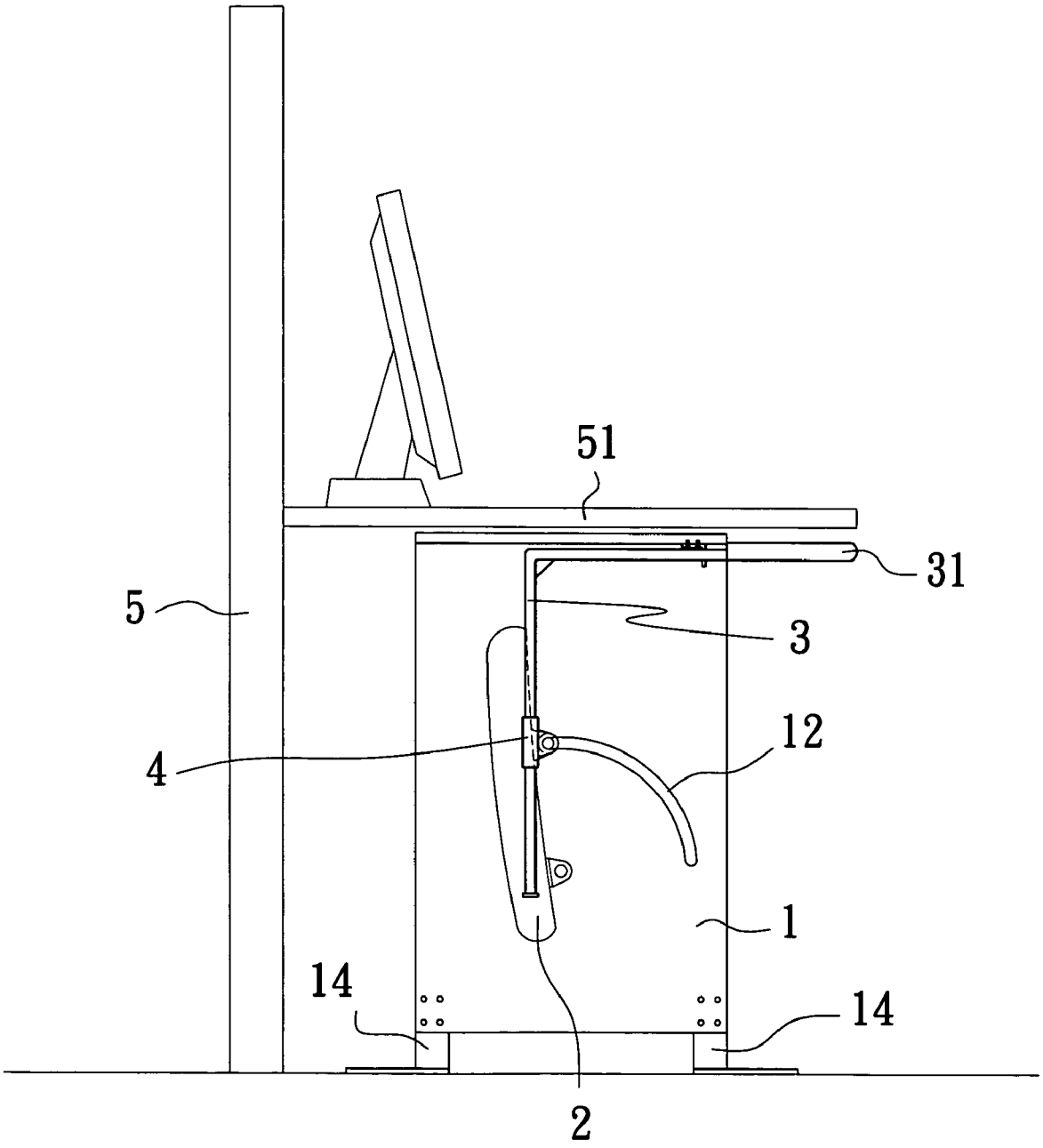
FIG. 7 illustrates the structure of the alternative embodiment of this invention under the state of use.

FIG. 6 illustrates the structure of an alternative embodiment of this invention. It is known from its state of utilization shown in FIG. 7 that the stand 1 is provided with a plurality of leg parts 14 formed at bottom portions of the two suspending portions 11. so that the leg support structure of the present invention can be directly placed underneath the desktop 51 without being engaged or attached to the undersides of the desktop 51. Therefore, the present invention provides an improved leg support structure of a computer desk that can accommodate to different operating surroundings.

This invention is related to a novel creation that makes a breakthrough in the art. Aforementioned explanations, however, are directed to the description of preferred embodiments according to this invention. Various changes and implementations can be made by persons skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

What is claimed is:

1. A leg support structure of a computer desk capable of synchronous sliding movement, comprising:

a stand having an inverse U-shape, wherein the stand comprises an arcing groove formed at each midsection of two suspending portions thereof;

a leg pad having a planar configuration, wherein the leg pad comprises a lower pivot opening and an upper pivot opening formed on each lateral side of the leg pad, a lower pivot is positioned through the lower pivot openings of the leg pad in order to pivot the leg pad about a support located at a center of the two arcing grooves;

two L-shaped prop stands, each having a horizontal side and a vertical side, wherein the horizontal sides of the two L-shaped prop stands are engaged to an underside of a top portion of the stand by a retaining sleeve, the horizontal sides are joined to a slider at ends thereof for a placement of a keyboard ; and two sliding collars having outer portions, each engaged over the vertical sides of the two L-shaped prop stands, wherein holes are formed at the outer portions of the sliding collars, an upper pivot passes through each of said holes to join with a pulley and then subsequently through a corresponding one of the upper pivot openings to pivot the two sliding collars to the upper pivot openings of the leg pad;

whereby outward sliding movement of the slider upon experiencing an external force actuates the L-shaped prop stands to cause movement of the sliding collars and to cause the pulley to slide downwards in the arcing grooves, subjecting the leg pad to be overturned and extended.

2. The leg support structure of a computer desk capable of synchronous sliding movement of claim 1, wherein the stand is provided on a top thereof with plural retaining holes through which plural fasteners pass to join to an underside of a desktop.

3. The leg support structure of a computer desk capable of synchronous sliding movement of claim 1, wherein a plurality of leg parts are formed at bottom portions of the two suspending portions of the stand so that the leg supporting structure can be placed directly underneath a desktop without being attached or connected to undersides of the desktop.

* * * * *